United States Patent [19]

Schwarze

[11] Patent Number: 4,537,053

[45] Date of Patent: Aug. 27, 1985

[54] PIPE BENDING MACHINE

[76] Inventor: Rigobert Schwarze, Olpener Str. 460–474, 500 Cologne 91, Fed. Rep. of Germany

[21] Appl. No.: 442,444

[22] Filed: Nov. 17, 1982

[30] Foreign Application Priority Data

Dec. 15, 1981 [DE] Fed. Rep. of Germany ..... 3149557

[51] Int. Cl.[3] ..... B21D 7/04

[52] U.S. Cl. ..... 72/157; 72/159

[58] Field of Search ..... 72/149, 150, 155, 156, 72/157, 158, 159, 442

[56] References Cited

U.S. PATENT DOCUMENTS

| | | | |
|---|---|---|---|
| 3,584,492 | 6/1971 | Dodge | 72/159 |
| 4,038,853 | 8/1977 | Schwarze | 72/157 |
| 4,236,398 | 12/1980 | Schwarze | 72/157 |
| 4,416,136 | 11/1983 | Schwarze | 72/159 |

FOREIGN PATENT DOCUMENTS

| | | | |
|---|---|---|---|
| 1174598 | 7/1964 | Fed. Rep. of Germany | 72/157 |
| 295153 | 2/1954 | Switzerland | 72/149 |
| 306275 | 6/1955 | Switzerland | 72/157 |
| 421667 | 4/1967 | Switzerland | 72/149 |

*Primary Examiner*—E. Michael Combs
*Attorney, Agent, or Firm*—Michael J. Striker

[57] ABSTRACT

There is disclosed a pipe bending machine comprising a movable clamping unit for holding a pipe to be bent and feeding the pipe along a feed path. A slidable guide rail extends in the longitudinal direction of the feed path to guide the pipe. Bending of the pipe is carried out at a pivotable bending table, which carries a template provided, at two opposite sides thereof and in a single plane, with two curved bending surfaces of different radii. Clamping devices are present for clamping the pipe to either one of the surfaces. A displacing device is provided to displace the template in a horizontal plane and relative to the guide rail to compensate for any eccentricity of the center of curvature of either or each of the surfaces with respect to the pivot axis.

26 Claims, 17 Drawing Figures

FIG.3
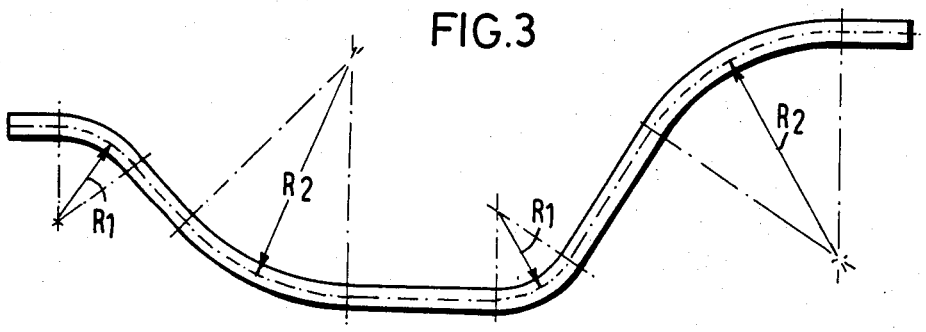
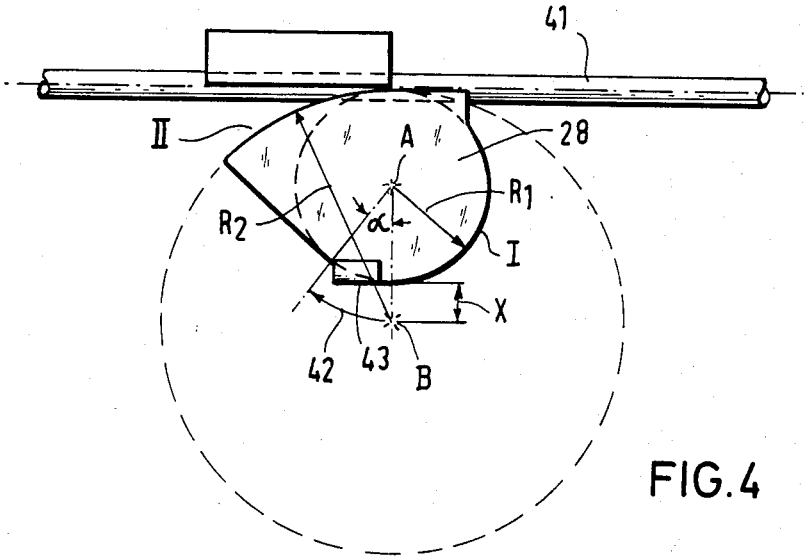
FIG.4

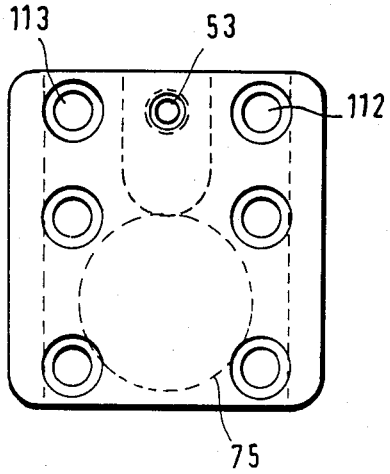
FIG. 16
FIG. 17
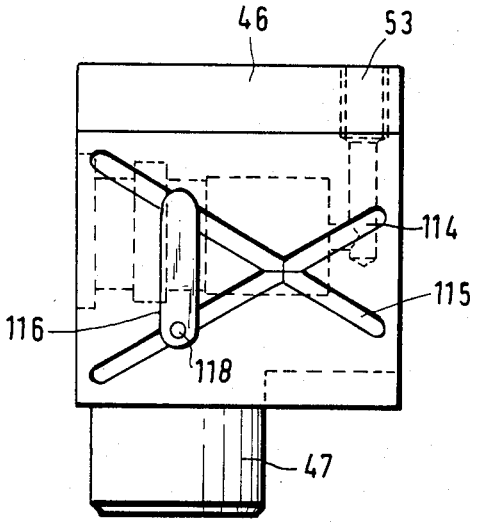

PIPE BENDING MACHINE

BACKGROUND OF THE INVENTION

The present invention relates to a pipe bending machine.

In the bending of pipes, it is generally endeavoured to form successive bends to have the same radius of curvature so that the bending template does not have to be changed during the bending process. However, there are many occasions in which a uniform bending radius is not appropriate or possible. Thus, for example, in the bending of exhaust pipes for motor vehicles it is desirable to calculate the radius of curvature in order to provide a certain back-pressure in the exhaust pipe. This calculated radius is not necessarily appropriate for all of the bends in the pipe however.

In German (Federal Republic) published specification (Offenlegungsschrift) No. 21 01 162 there is disclosed a fully automatic method of bending pipes on a numerically controlled pipe bending machine to provide several different bending radii but without change or alteration of the clamped position of the pipe during its advance. To this end, several bending templates of different diameter are coaxially arranged on a bending table one above the other, thus in the form of storeys. During the changeover from one bending template to another, a clamping sleeve carrying the pipe on an advancing carriage is appropriately raised or lowered. As a result, the formation of bends of different radii takes place in different planes. The raising and lowering of the clamping sleeve carrying the pipe cannot be performed rapidly, because the weight is substantial. In addition, the entire system generally involves a complicated construction.

Bending templates layered in the manner of storeys are also disclosed in U.S. Pat. Nos. 3,299,681 and 3,147,792. During changeover from one bending template to another, the desired new template is driven by a spindle into the appropriate setting. Although the bending of the pipes always takes place in the same plane in this case, the raising and lowering of the bending templates through a single spindle is time-consuming. Moreover, the bending machines are bulky in the region of the templates.

In German (Federal Republic) Patent Specification No. 27 46 721 there is disclosed a pipe bending machine in which templates are arranged to be axially displaceable relative to each other, wherein in an initial setting an outer annular template surrounds an inner template. In this arrangement, it is necessary, during bending with bending templates of different radii, to laterally displace the advancing carriage with the clamping sleeve carrying the pipe to be bent. This operation requires a corresponding amount of time.

SUMMARY OF THE INVENTION

The present invention accordingly has as its principal object the provision of a pipe bending machine which enables formation of bends with different radii of curvature without requiring lateral displacement of the pipe axis during the bending process, in particular lateral displacement of holding and feeding means for holding and feeding the pipe.

A supplementary object of the invention is the provision of a pipe bending machine having the above-mentioned advantage, wherein the machine can be produced by appropriate adaptation of an existing machine.

Other objects and advantages of the present invention will be apparent from the following description:

According to the present invention there is provided a pipe bending machine comprising pipe bending and feeding means operative to hold a pipe to be bent and movable to feed the pipe along a feed path. A slidable guide member extends in the longitudinal direction of the feed path for guidance of the pipe. Bending of the pipe is effected at a bending table carrying a bending template which is movable with the table and provided at each of two opposite sides and in a single plane with a respective one of two curved bending surfaces of different radii for selective bending of the pipe therearound when the table, together with the template, is pivoted. Clamping devices are provided to clamp the pipe to either one of the curved surfaces and a displacing means is arranged to displace the template in a horizontal plane and relative to the longitudinal direction of the feed path to compensate for any eccentricity of the centre of curvature of either or each of the curved surfaces with respect to the pivot axis of the table.

Such an arrangement has the advantage that a rapid changeover of the curved bending surfaces may be possible and bending can be performed around either surface without requiring lateral displacement of the pipe axis during the bending process.

Preferably, the displacing means is arranged co-axially with the pivot axis of the bending table and during bending with the curved surface having the smaller radius of curvature or the surface having the larger radius of curvature, the tangent of the guide member at the template has a constant spacing from the pivot axis, this spacing corresponding to the radius of the curved surface having the smaller radius of curvature.

Expediently, these surfaces extend over an angular range of up to 60°, preferably a range of 45°.

For preference, a substantially rectangular recess is present in the central region of the template and the displacing means has a guide element disposed in the recess. The guide element may be fastened by a downwardly directed spigot in the centre of an intermediate plate arranged on the table and preferably comprises a cylinder space with a piston, one end of which projects out of the cylinder space and bears against the template. For preference, said one end of the piston bears against a wall of the recess adjacent to the larger radius curved surface.

The centre of the elongate recess is preferably displaced through 45° to the respective bending start of each of the curved surfaces, and the spacing of the larger radius curved surface from the centre of rotation of the spigot preferably corresponds to the radius of the surface with the smaller radius. In addition, rectilinear limitations may be provided to adjoin clamping surfaces between the curved surfaces.

Because the surface with the smaller radius has, during its use, a constant spacing from the pivot axis of the displacing means, a pipe clamping member co-operating therewith can be of a conventional type. To advantage, this clamping member is pivotable upwardly about a horizontal axis by a displacing device, for example a toggle lever eccentric drive, so that it is rapidly movable out of the effective range of the template and into a position adequately spaced therefrom.

Since, during bending with the curved surface having the larger radius, the template displaces with respect to the pivot axis of the bending table and thus the pivot axis of the displacing means, a clamping device of a type which is moved in a horizontal plane would have to adapt itself to the displacement of the template during the bending. As this would give rise to substantial difficulties, the clamping device associated with the curved surface having the larger radius of curvature preferably comprises a clamping member which is fastened to the template and moved in vertical plane. For this purpose, a clamping surface at the template surface with the larger radius may have the cross-sectional shape of a quadrant and clamping of a pipe is effected over three-quarters of its circumference in conjunction with the vertically moved clamping member. This clamping device is preferably in the form of a double-acting piston cylinder unit with the piston connected to the template and the cylinder to the clamping member. In particular, the device may comprise an upwardly projecting rod which is connected with the template and surrounded by a cylinder casing at the lower end of which the clamping member is secured. The cylinder casing in its lower region has a ring connected therewith, which is slidably movable, through sealing elements, along the rod. The rod is surrounded at its upper end by an annular piston member, which is slidably movable, with the interposition of sealing elements, along the inside wall of the cylinder casing. A first working chamber space fillable with a pressure fluid such as oil by way of a connecting duct is present between the ring and the piston member for the lowering of the cylinder casing and clamping member, while a second working chamber, fillable with a pressure fluid through a further connecting duct, is present above the piston member for the raising of the cylinder casing and clamping member.

BRIEF DESCRIPTION OF THE DRAWINGS

An embodiment of the present invention will now be more particularly described, by way of example, with reference to the accompanying drawings, in which:

FIG. 3 is a plan view of a pipe bent at different radii of curvature by the machine;

FIG. 4 is a schematic plan view of a bending template of the machine, showing bending sectors thereof with different radii of curvature and the relationship of the respective centres of curvature;

FIG. 16 is a plan view of the guide element; and

FIG. 17 is a side elevation of the guide element.

DESCRIPTION OF THE PREFERRED EMBODIMENT

Figure 1:
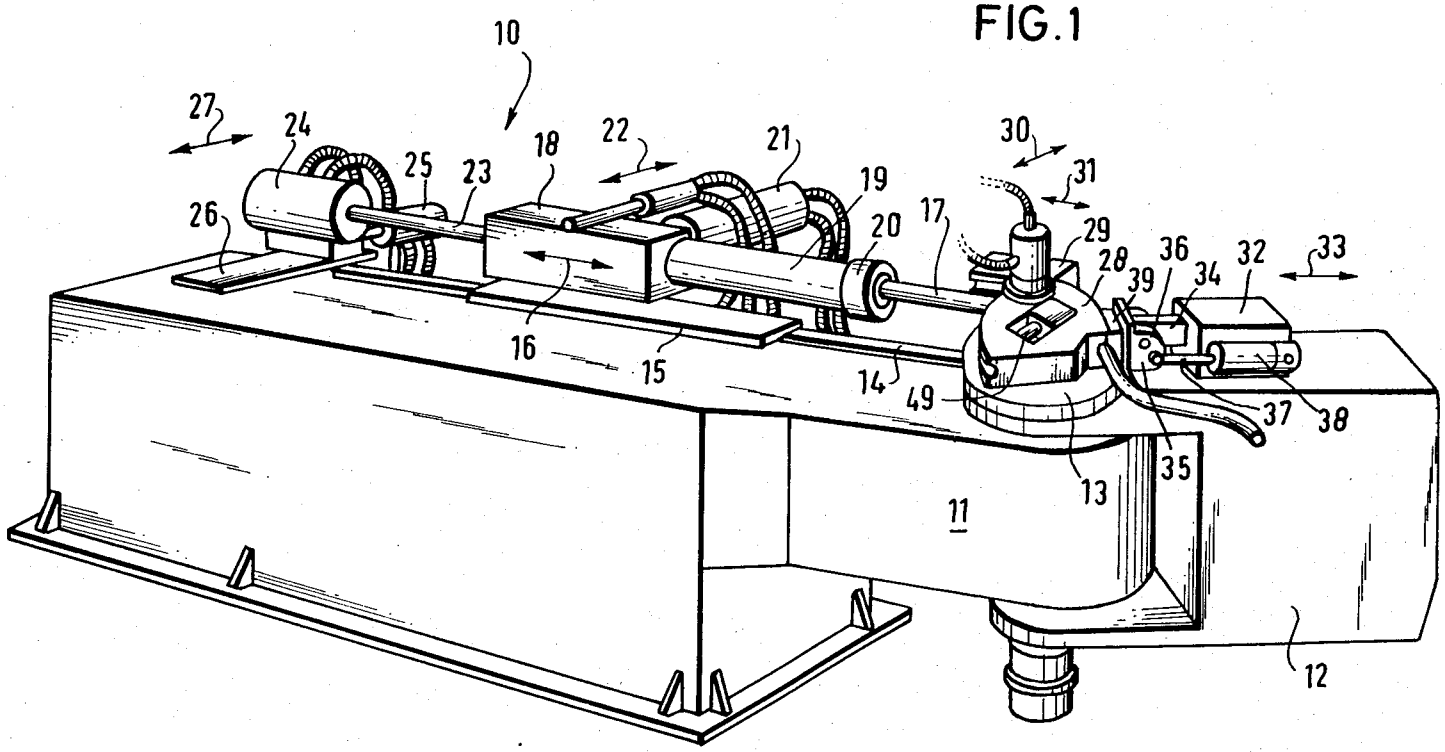
FIG. 1 is a schematic perspective view of a pipe bending machine embodying the invention.

Referring now to the drawings, there is shown in FIG. 1 a pipe bending machine 10 comprising a housing which consists of welded steel plates and which at its front end has a projection 11. The projection 11 carries a bending table 12, constructed as a pivot arm, with a support plate 13. Arranged at the upper side of the housing is a rail 14, on which a carriage 15 is reciprocatingly displaceable in the direction of arrow 16 parallel to the direction of advance of a pipe 17 to be bent. The carriage 15 carries a housing 18 on which is mounted a cylinder 19 provided in its interior and front end with a clamping sleeve 20. The carriage 15, housing 18 and cylinder 19 together constitute an advancing carriage. The advancing carriage is provided with a hydraulic piston-cylinder unit 21, which can reciprocatingly displace the cylinder 19 and clamping sleeve 20 in the direction of arrow 22 for a purpose which will be subsequently described.

For bending of the pipe 17 with internal support there is provided a mandrel 23, which is held by a mandrel holder 24 displaceable in the direction of arrow 27 along a rail 26 by means of a hydraulic piston-cylinder unit 25.

The pipe 17 to be bent is laid against a bending template 28, which will be described in more detail later, on the support plate 13. Bearing against the pipe is a slide rail 29 which is reciprocatingly displaceable in the directions of arrow 30 as well as in the direction of arrow 31 and which travels with the pipe during pivoting of the table 12 together with the template 28. The pipe can be clamped to one side of the template by a clamping device which comprises a clamping carriage 32 reciprocatingly displaceable through a toggle lever drive in the direction of arrow 33, as will be explained in more detail in connection with FIG. 13. The carriage 32 is provided at its front end with a carrier 34, which carries a clamping cheek mount 35 pivotable about an axle 36. Pivotation of the mount 35 can be effected by a piston rod 37, pivotably coupled to the mount 35, of a piston-cylinder unit 38. The mount 35 carries a clamping cheek 39, which is adapted to the diameter of the particular pipe to be bent and is detachably connected to the mount 35.

Figure 2:
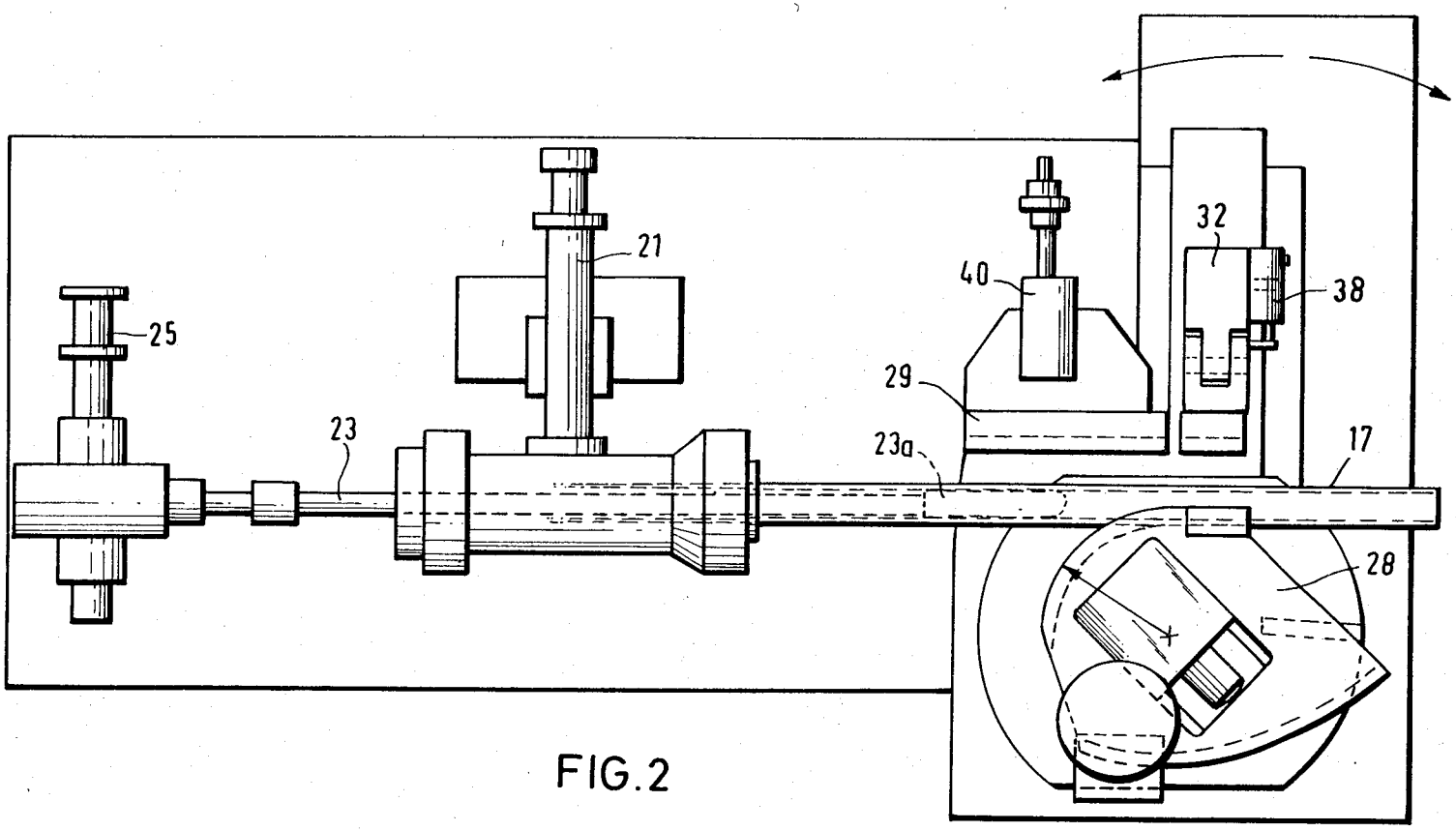
FIG. 2 is a plan view, to an enlarged scale of the pipe bending machine, with a bending table thereof in a different angular position compared with that of FIG. 1.

FIG. 2 shows that the slide rail 29 is provided with a piston-cylinder unit 40 acting on the slide rail to cause it to press the pipe with adequate pressure against the template. FIG. 2 also shows a mandrel head 23*a*, present at the head of a rod of the mandrel, within the pipe.

The bending template 28 is provided in one plane at two oppositely disposed sides thereof with bending template surfaces or sectors I and II of different radii of curvature, in order that pipes can be provided with bends of different radii as shown in FIG. 3. The pipe of FIG. 3 has bends with the radii R1 and R2, which are produced by the template 28 illustrated in FIG. 4. The template sector I has the radius R1 and a centre A and the sector II has the radius R2 and a centre B.

The sectors extend, according to FIG. 4, over an angle of 45°. However, an angular extent of up to about 60° is also possible. Whereas known bending templates of different diameter had a common centre, the bending template 28 has a respective centre for each of the sectors, thus the centre A for the sector I with the smaller radius R1 and the centre B for the sector II with the larger radius R2. The pivot axis of the bending table coincides with the centre A of the sector I. As the axis of the pipe 41 is not to be displaced in the pipe bending machine, depending on whether bending is carried out with the sector I or with the sector II a displacement of the template can be effected to compensate for the difference between the sector radii. When bending is performed with the template sector I, thus with the radius R1, displacement of the template is not necessary because the centre A coincides with the pivot axis of the bending table. When, however, the template sector II, thus larger radius R2, is used for bending, then displacement of the template is effected, the amount of the displacement depending on the bending angle. If the pipe is bent through an angle $\alpha$ of, for example, 30° around the sector II, then this determines a necessary displacement of the amount X (FIG. 4) and not an amount which corresponds to the spacing of the centres A and B, because bending is effected only through the limited angle of 30° and not through a full 360°. If the angle of bending is larger, for example 50°, then the necessary displacement X is correspondingly greater. The displacement amount can be determined in graphical manner by drawing a line from the centre A to the centre B and a circle 42 around the centre A according to the spacing B from A. The bending angle $\alpha$ is then drawn in and at the place at which it meets the circle 42, a line 43 is drawn perpendicular to the line from A to B. The necessary displacement amount can be determined according to this method in dependence on the different radii and the maximum bending angle.

The displacement is preferably effected by displacing equipment which is constructed so that it is applicable to other bending radii.

Figure 5:
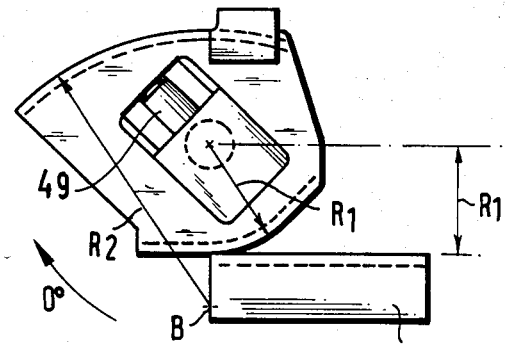
FIGS. 5 to 7 are schematic plan views of the template and associated guide rail in, respectively, three different stages of bending around the sector with the smaller radius.
Figure 8:
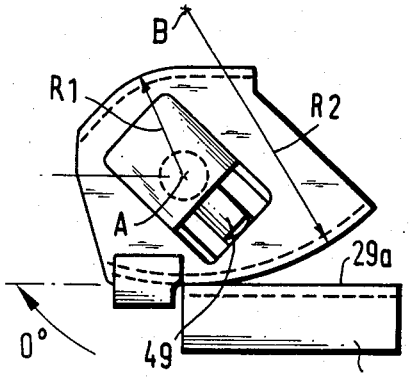
FIGS. 8 to 10 are schematic plan views of the template and associated guide rail in, respectively, three different stages of bending around the sector with the larger radius.
Figure 6:
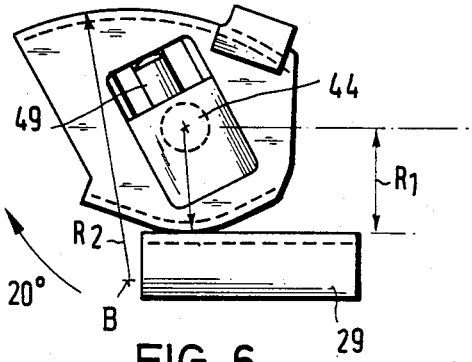
Figure 9:
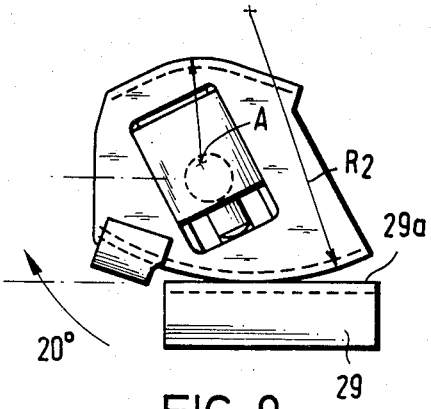
Figure 7:
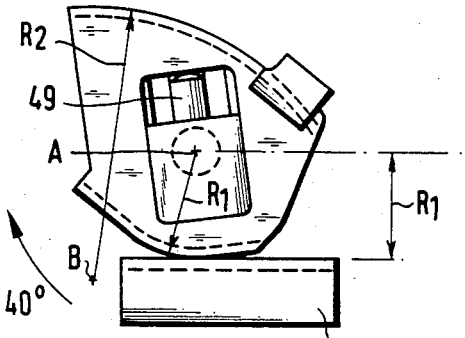
Figure 10:
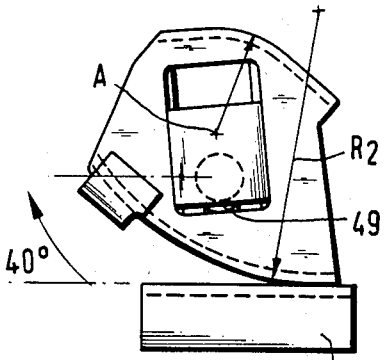

In particular, the displacement takes place through a movement compensating device 44, the manner of operation of which is evident from FIGS. 5 to 10, wherein FIGS. 5 to 7 show bending with the smaller radius R1 and FIGS. 8 to 10 bending with the larger radius R2. FIG. 5 shows that the centre A for the sector with the radius R1 has a constant spacing from the slide rail 29, because this centre coincides with the pivot axis of the bending table. FIG. 5 shows the initial bending position of 0°, FIG. 6 the bending position at 20° and FIG. 7 the position at 40°. It can be seen that no displacement of the template has taken place apart from rotation about the centre A. When bending is to be carried out with the sector having the larger radius R2, as is illustrated in FIGS. 8 to 10, then the movement compensating device comes into operation.

Figure 11:
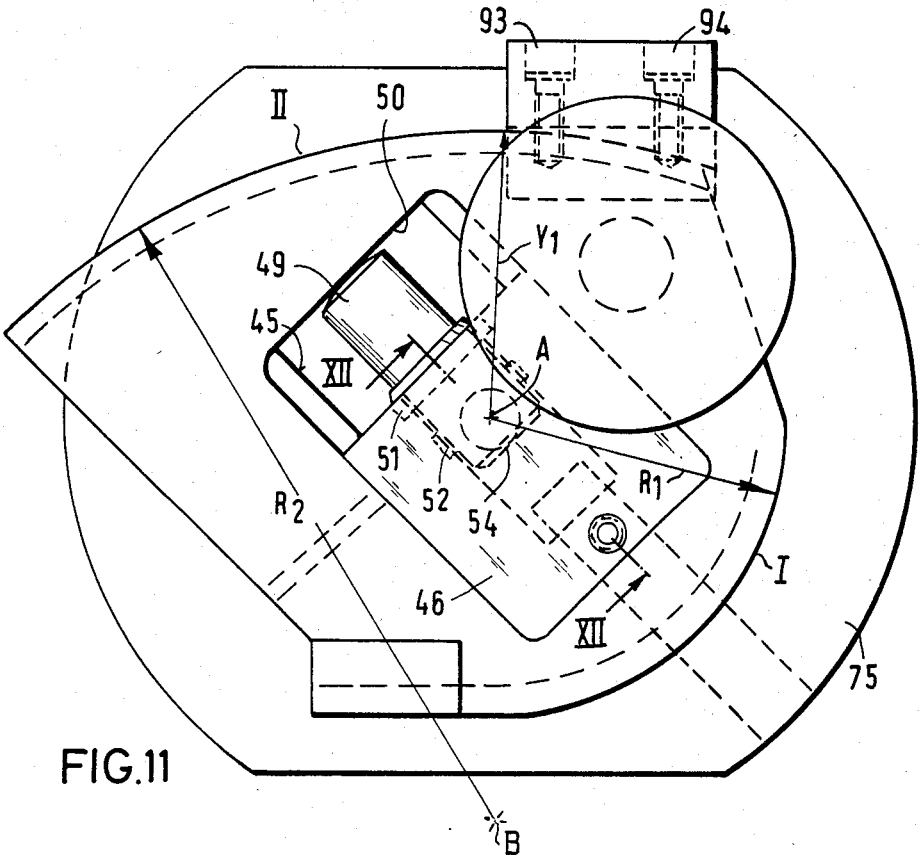
FIG. 11 is a plan view, to an enlarged scale, of the template including a displacing device thereof.
Figure 12:
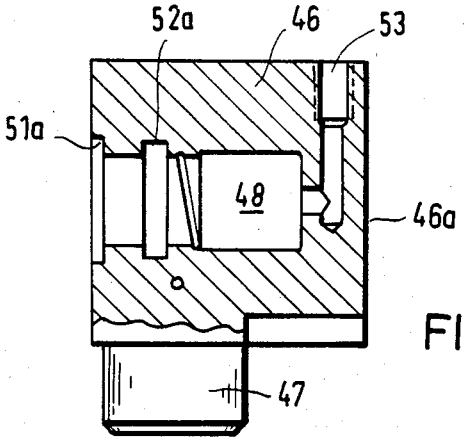
FIG. 12 is a side elevation, partially sectioned on the line XII—XII of FIG. 12, of a guide element of the displacing device.

The movement compensating device is accommodated in a rectangular opening 45 in the preferably one-piece template 28, the centre of the opening preferably being displaced through 45° relative to the bending start of each of the sectors I and II. Arranged in the elongate recess is a guide element 46, which is provided at its top with a collar or a cover plate. The element 46 has a downwardly directed machine-turned spigot 47 which is centered in a bore at the bending table, for example in the support plate 13 (FIG. 1) or intermediate plate 75 (FIG. 13), and which coincides with the pivot axis of the bending table. In addition, the guide element is firmly secured to the table or plate by screws. The spigot 47 also represents the centre A for the template sector I with the smaller radius of curvature R1. The spacing Y1 (FIG. 11) of the start of the sector II from the centre A is equal to the radius R1. The guide element 46 defines a cylinder space 48, in which a piston 49 is arranged to be slidably movable, the piston being arranged to bear against the wall 50 of the opening 45 closest to the sector II. The piston 49 is sealed off by associated seals 51 and 52 in recesses 51*a* and 52*a* from a pneumatic or hydraulic, preferably hydraulic, pressure fluid, for example oil, fed to the cylinder space 48 through a feed duct 53 from a pump. At a high pressure of the pressure medium in a working chamber of the cylinder space 48, the piston 49 is pressed to a maximum extent out of the guide element. Such a pressure condition is present during bending around the template sector I as shown in FIGS. 5 to 7. As is apparent from these figures, a constant length of the piston 49 protrudes from the guide element and the element during the bending thus has an unchanged position within the opening 45 of the template. As a head end 46*a* (FIG. 12) of the guide element bears against a wall of the opening 45 and the slide rail 29 exerts a pressure on the template through the pipe to be bent, no oil pressure need in fact be present in the cylinder space 48. This is also because the centering spigot 47 determines the centre of curvature of the sector I. The conditions are different during bending with the sector II according to FIGS. 8 to 10. FIG. 8 shows the initial position, prior to bending, in the same manner as FIG. 5. FIG. 9 shows the bending position at an angle of 20° and FIG. 10 the bending position at an angle of 40°. Whereas, according to FIG. 8, the guide element with the piston 49 prior to bending has the same setting as is the case during the bending according to FIGS. 5 to 6, FIG. 9 shows that the template has displaced relative to the guide element because the piston 49, under the effect of the pressure of the slide rail 21, has been pressed back into the cylinder space 48 and the template 38 is correspondingly displaced relative to the guide element, because the spigot 47 thereof is and remains coaxial with the pivot axis of the table. Through setting of a certain counter-pressure in the cylinder space 48, the pressure of the slide rail 21 can be set with the interposition of the pipe at the table or, in other words, a sufficiently strong counterpressure must be exerted on the template in the direction of the slide rail.

It is evident from FIGS. 5 to 10 that the spacing of the centre A of the spigot and thus of the bending template from the longitudinal edge 29*a* of the slide rail 29 is always the same, i.e. no lateral displacement of the pipe need take place during the bending of the pipe to form bends with different radii of curvature.

During bending with the template sector II with the larger radius, the bending speed increases with increasing bending angle. This must be taken into consideration in the control of the advancing carriage. Since the tangential point of the contact of the slide rail with the template wanders towards the slide rail end with increasing bending angle, this movement must also be taken into consideration during calculation of the pipe advance through the advancing carriage.

Since no displacement of the template takes place during bending with the template sector I with the smaller radius of curvature, a pipe clamping cheek of a generally conventional kind can be used. It is advantageous, however, in the case of the arrangement described for FIG. 1 in which the mount 35 carries the exchangeable clamping cheek 39 resting against the pipe to be clamped, to provide for upward pivotable movement of the mount about a horizontal axle 36 in order to quickly and simply move it out of the effective range of the template when the next bending step is to take place with the template sector II.

Figure 13:
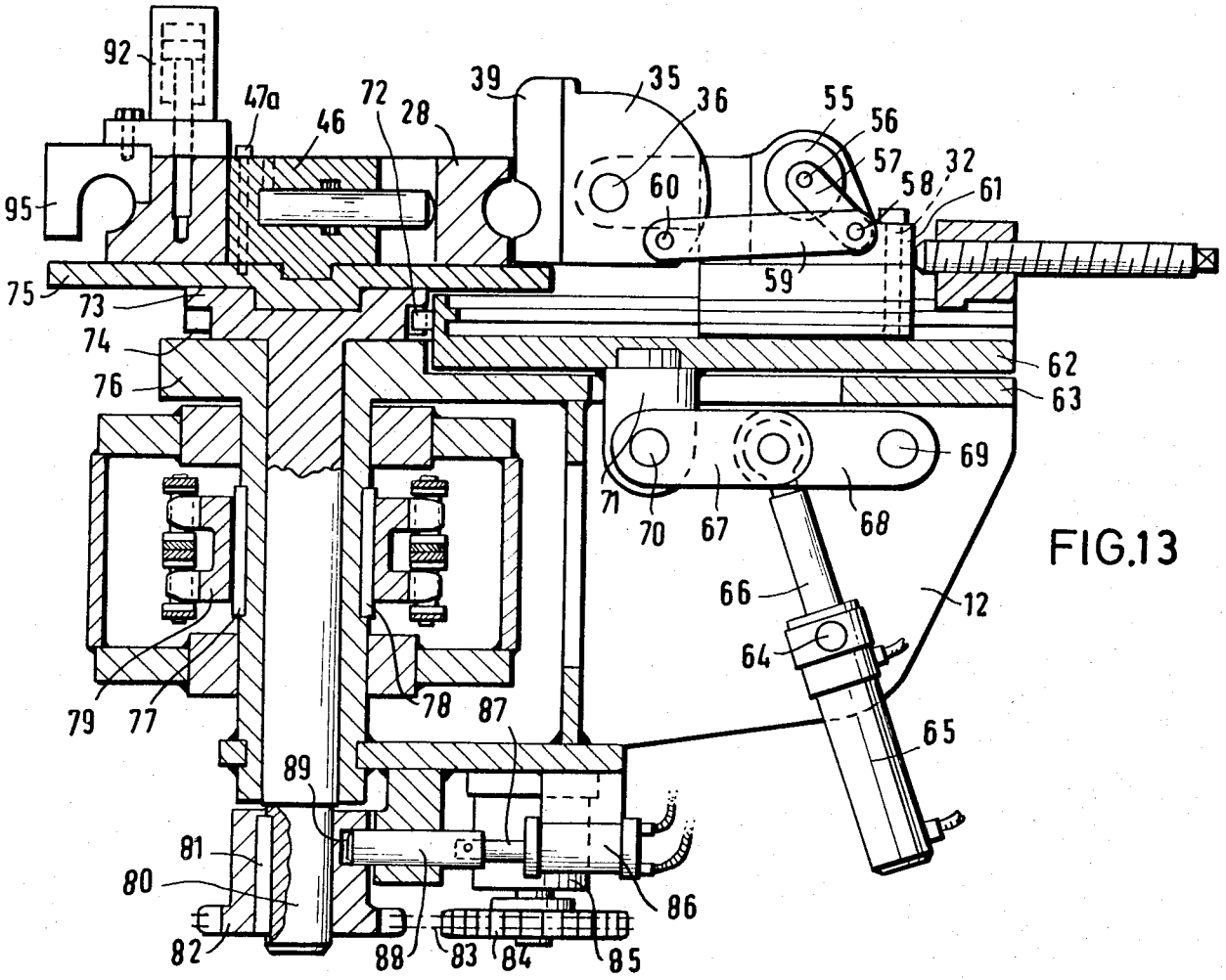
FIG. 13 is a vertical cross-section of the bending table and template of the machine, together with associated clamping devices and drives.

FIG. 13 shows a clamping device which operates in basically the same manner as that illustrated in FIG. 1, but which is of slightly different construction. The clamping device comprises a carriage 32 with a hydraulic motor 55 having an output shaft 56 carrying an arm 57. The arm 57 is connected through a pin 58, a further arm 59 and a pin 60 with the mount 35. On rotation of the motor 55 in clockwise sense, the mount 35 is pivoted upwardly around the axle 56, as explained in connection with FIG. 1. The carriage 32 is connected by screws 61 with a carriage 62, which is displaceable along a rail 63. Displacement of the carriage is effected by a hydraulic piston-cylinder unit 65, the piston rod 66 of which is pivotably connected with two links 67 and 68 and the cylinder of which is connected by a pin 64 to the bending table 12. The link 68 is connected by a pin 69 with the table 12 and the link 67 is connected by a pin 70 and a lug 71 to the carriage 62. When the piston rod 66 is drawn into the cylinder 65, the carriage 62 moves to the right. When the piston rod is extended from the cylinder, the carriage is displaced to the left through the illustrated pivotable links. Arranged at the front of the carriage 62 is a lug 72, which engages in a corresponding recess in a support flange 73 of an axle 80. The flange 73 has a further such recess 74 displaced through 180° relative to the first-mentioned recess. Through the engagement of the lug 72 into either recess, it is ensured that the template is aligned with the clamping cheek 39.

The guide element 46, which engages through the spigot 47 into the intermediate plate 75, is connected by screws 47*a* with the intermediate plate. The intermediate plate rests on the flange 73 and is secured thereto by screws and two wedges. The flange 73 rests on the top of a hollow shaft 76, which receives the axle 80 and is connected by keys 77 and 78 to a chain drive 79. A toothed wheel 82 is coupled by a key 81 to the lower end of the axle 80 and is rotationally drivable by a chain 83 connected to a chain wheel 84 of a hydraulic motor 85. Rotation of the axle 80, and thus of the template 28 connected thereto, relative to the bending table 12 can only take place after a locking pin 88, which engages in a recess 89 of the toothed wheel 82, has been drawn back by a piston rod 87 of a piston-cylinder unit 86. When the mount 35 and clamping cheek 39 are drawn back through retraction of the piston rod 66 in the manner described above and at the same time pivoted upwardly about the axle 36 by the hydraulic motor 55 in order that an adequate spacing from the template is present, the bending template can be pivoted through 180° after withdrawal of the locking pin 88 and rotation of the axle 80 in order that the template sector II is moved through 180° into the bending position.

For bending with the template sector I, the carriage 32 advances until its lug 72 engages in the corresponding one of the recesses in the flange 73 and the clamping cheek 39 firmly clamps the pipe at the clamping region of the template. The pipe is then hydraulically pushed forward with the mandrel and the slide rail 29 subsequently advances hydraulically. Thereafter, the pipe is bent through the bending angle determined by the template position. In that case, the slide rail moves along tangentially as is evident from the FIGS. 5 to 7. The pipe remains firmly clamped in the clamping sleeve 20 so that the carriage moves along as production of the bend progresses. After the bending, the mandrel is moved back in known manner and the clamping cheek 39 is moved away and pivoted upwardly. The slider rail 29 is also moved back. Subsequently, the bending table is returned to its initial setting by its drive and the bending template is also returned to its initial setting. The advancing carriage carrying the clamping sleeve then moves forward, for example by an amount equal to the length of a straight section of the pipe between bends.

If the next bend is also to be performed on the sector I with the smaller bending radius, then the pipe with the mandrel disposed therein is moved forward and, if the bend is in the opposite direction to the preceding bend, rotated with the cylinder 19 and sleeve 20.

If the bending is to be performed with the template sector II having the larger radius, then the cylinder 19, sleeve 20 and holder 24 are first moved away laterally by the hydraulic piston-cylinder units 21 and 25. The template 28 is then rotated in clockwise sense through 180° by the drive 82 to 85 described in connection with FIG. 13 so that the template setting template illustrated in FIG. 8 results. Previously, the piston rod 37 of the hydraulic piston-cylinder unit 38 is extended in order to pivot the mount 35 and clamping cheek 39 upwardly. The cylinder 19, sleeve 20 and mandrel holder 24 are then returned to their initial settings by the associated piston-cylinder units 21 and 25.

Figure 14:
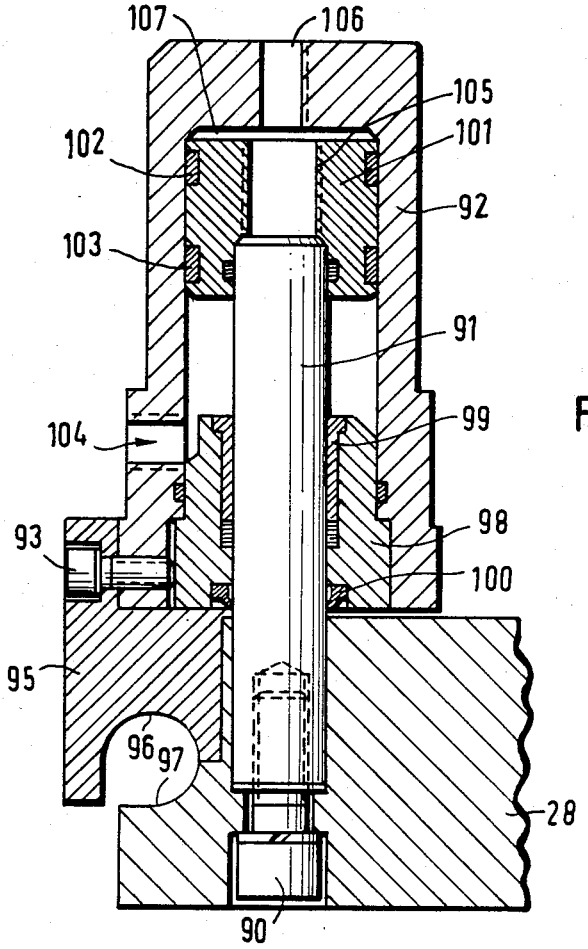
FIG. 14 is a vertical section, to an enlarged scale, of a clamping device mounted on the template.

Since, during bending with the template sector II, the template is displaced relative to the stationary guide element 46 over the intermediate plate 75 with progressive bending as is evident from FIGS. 8 to 10, the usual form of clamping cheek cannot be used. Instead, a respective clamping cheek 95 is arranged on the template in association with the sector II and is movable in a vertical plane, the clamping cheek being part of a clamping device illustrated in FIG. 14. The clamping device comprises an upwardly projecting spigot 91 which is secured to the template by a screw 90 inserted from the underside of the template and which is surrounded by a cylinder 92. Secured to the lower end of the cylinder 92 by screws 93 and 94 (FIGS. 11 and 14) is the clamping cheek 95. In cross-section, the clamping cheek 95 has a semi-circular clamping surface 96, while the template 28 is provided with a clamping surface 97 which has the shape of a quadrant in cross-section. The cylinder 92 surrounds and is connected to a ring 98, which is slidable by sealing elements 99 and 100 along the spigot 91. At its head end the spigot 91 carries a ring 101, which is sealed relative to the cylinder wall by associated seals 102 and 103.

If oil under pressure is fed through an inlet opening 104, then the cylinder 92 with the clamping cheek 95 is lowered, because the ring 101 is firmly connected through a thread 105 with the spigot 91 and pressure is exerted in opposite directions on the underside of the ring 101 and the top side of the ring 98.

For opening of clamping cheek 95, oil is fed under pressure through an inlet opening 106. This oil passes into a space 107 above the ring 101 with the result that the cylinder 92 and the clamping cheek 95 are raised as the oil effects an enlargement of the space 106.

Figure 15:
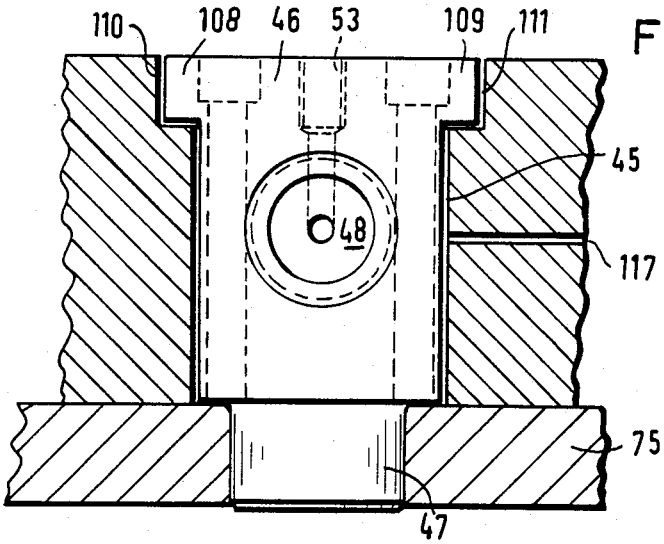
FIG. 15 is a sectional view of part of the template showing, in end view, the guide element of FIG. 12.

It will be apparent that the bending template 28 can easily be mounted on an existing pipe bending machine, because the template is merely to be laid on the intermediate plate or bending table and the guide element 46 secured thereto. Collars or ribs 108 and 109, which extend in longitudinal direction at both sides of the guide element, then secure the template. These collars which engage in associated depressions 110 and 111 in the template, are shown in FIG. 15. FIG. 16 shows that bores 112 and 113 are present in the guide element adjacent to its longitudinal sides for reception of screws for securing the guide element to the intermediate plate 75.

It is evident from the foregoing description that the guide element 46 does not turn around the axis of the spigot 47 in the sense of the spigot acting as an axle. The spigot does not, in fact, need to be present. It is, however, expedient as a centering spigot to provide an exact centering at the rotational axis of the intermediate plate 75 and to ensure that the rear wall 46*a*, shown in FIG. 12, rests against the associated wall of the opening 45.

As shown in FIG. 17, the guide element 46 has lubricating grooves 114 and 115 at both of its longitudinal sides and a grease chamber 116. The lubricating grooves 114 and 115 at one side of the guide element receive lubricant from a lubricant duct 117 in the template (FIG. 15). The lubricating grooves at the other side of the guide element receive the lubricant via a bore 118 (FIG. 17) in the guide element.

I claim:

1. A pipe bending machine comprising means defining a feed path;

pipe holding and feeding means operative to hold a pipe to be bent and movable to feed said pipe along said feed path;

a slidable guide member extending in the longitudinal direction of said feed path for guidance of said pipe;

a feed table mounted for pivotation about an axis;

a bending template shiftably mounted on said table to be movable therewith and comprising means defining two curved bending surfaces disposed one at each of two substantially opposite sides of said template and in a single plane for selective bending there-around of said pipe on pivotation of said table with said template, said two curved bending surfaces being of respectively different radii;

clamping means movable with said template and cooperable with said template for clamping of said pipe selectively to said curved bending surfaces in dependence on the radius of a bend to be formed in said pipe;

displacing means operatively connected with said template and operable to displace said template during the bending of the pipe in a horizontal plane and relative to said longitudinal direction of said feed path to compensate for any eccentricity of the center of curvature of either or each of said curved bending surfaces with respect to said axis of pivotation of said bending table; and wherein said displacing means is arranged coaxially with said axis of pivotation of said bending table and is adapted to so control the position of said template on said bending table as to maintain a constant spacing between said axis of pivotation and a point of tangency of said slidable guide member with said template during bending of said pipe around either one of said curved bending surfaces, said spacing being equal to the length of a smaller one of said radii, whereby during bending of the pipe around the curved bending surface of smaller radius the position of said template on said bending table remains unchanged whereas in bending the pipe around the curved bending surface of the larger radius said displacing means continuously urges said template against said slidable guide member.

2. A pipe bending machine according to claim 1, wherein said template comprises means defining a recess in a substantially central region thereof and said displacing means comprises a guide element which is guided in said recess and connected to said table to be movable therewith, said guide element comprising means defining a substantially horizontally extending cylinder and a piston which is slidably engaged in said cylinder and which is engageable with said template and displaceable to cause or allow said template to displace relative to said guide element.

3. A pipe bending machine according to claim 2, wherein said guide element further comprises means defining a downwardly directed centering projection disposed to locate said guide element relative to the said axis of pivotation of said bending table.

4. A pipe bending machine according to claim 2, comprising means to feed a fluid pressure medium to said cylinder and means to regulate the pressure of said medium in said cylinder.

5. A pipe bending machine according to claim 2, wherein the centre of said recess is displaced through substantially 45° relative to a bending start end of each of said curved bending surfaces.

6. A pipe bending machine according to claim 2, wherein the spacing of said axis of pivotation of said bending table from a bending start end of one of said curved bending surfaces with a larger one of said radii is substantially equal to the length of the radius of the other one of said curved bending surfaces.

7. A pipe bending machine according to claim 2, wherein said recess is substantially rectangular and is arranged with one of its sides closer to one of said curved bending surfaces having a larger one of said radii than the remaining sides of said recess, and said piston bears at an end thereof facing outwardly of said cylinder against said one of the sides of said recess.

8. A pipe bending machine according to claim 2, wherein said template is provided with means defining guide channels adjoining said recess and said guide element is provided at each of two opposite sides thereof extending in the direction of displacement of said template with means defining a respective rib engaging in a respective one of said channels.

9. A pipe bending machine according to claim 2, wherein said guide element is provided at each of two opposite sides thereof extending in the direction of displacement of said template with means defining lubricating grooves for reception of lubricant.

10. A pipe bending machine according to claim 2 comprising an intermediate plate secured to said bending table, said guide element being mounted on said intermediate plate.

11. A pipe bending machine accordint to claim 1, wherein said template comprises means defining clamping surfaces for clamping thereto of said pipe to be selectively bent around said curved bending surfaces, and means defining substantially rectilinearly extending surfaces adjoining said clamping surfaces in a region between said curved bending surfaces; said clamping means comprising a first clamping member associated with one of said curved bending surfaces having a smaller one of said radii, said clamping member being mounted on the table and a second clamping member associated with one of said curved bending surfaces having a larger one of said radii, said clamping member being arranged on said template to be movable in a substantially vertical direction.

12. A pipe bending machine according to claim 11, wherein said template comprises means defining a clamping surface which is quadrant-shaped in cross-section and which is co-operable with said substantially vertically movable clamping member to effect clamping of said pipe around substantially three-quarters of the circumference thereof.

13. A pipe bending machine according to claim 11, wherein said second clamping means further comprises a double-acting piston-cylinder unit, the piston of said unit being fixed to said template and the cylinder of said unit being connected to said substantially vertically movable clamping member.

14. A pipe bending machine according to claim 13, wherein said piston-cylinder unit comprises a piston rod connected to and extending upwardly from said template; an annular piston member mounted on the upper end of said piston rod; a cylinder casing defining a cylinder space which receives said piston member and said piston rod, said piston member slidably engaging the circumferential wall of said cylinder space and said casing being provided at a lower end region thereof with an annular closure member slidably engaging said piston rod; sealing means arranged to effect a seal between said piston member and said circumferential wall of said cylinder space and between said piston rod and said closure member; first duct means for supplying a pressure fluid to a first portion of said cylinder space between said piston member and said closure member thereby to effect lowering of said casing; and second duct means for supplying a pressure fluid to a second portion of said cylinder space between said piston member and the upper end of said casing thereby to effect raising of said casing, said substantially vertically movable clamping member being secured to said casing at said lower end region thereof.

15. A pipe bending machine according to claim 14, wherein said template comprises means defining a socket and said piston rod is mounted in said socket, said template further comprising threaded fastening means inserted from the underside of said template to retain said piston rod in said socket.

16. A pipe bending machine comprising means defining a feed path;

pipe holding and feeding means operative to hold a pipe to be bent and movable to feed said pipe along said feed path;

a slidable guide member extending in the longitudinal direction of said feed path for guidance of said pipe;

a feed table mounted for pivotation about an axis;

a bending template shiftably mounted on said table to be movable therewith and comprising means defining two curved bending surfaces disposed one at each of two substantially opposite sides of said template and in a single plane for selective bending there-around of said pipe on pivotation of said table with said template, said two curved bending surfaces being of respectively different radii;

clamping means movable with said template and co-operable with said template for clamping of said pipe selectively to said curved bending surfaces in dependence on the radius of a bend to be formed in said pipe;

displacing means operatively connected with said template and operable to displace said template during the bending of the pipe in a horizontal plane and relative to said longitudinal direction of said feed path to compensate for any eccentricity of the centre of curvature of either or each of said curved bending surfaces with respect to said axis of pivotation of said bending table; and wherein said template comprises means defining a recess in a substantially central region thereof and said displacing means comprises a guide element of which is guided in said recess and connected to said table to be movable therewith, said guide element comprising means defining a substantially horizontally extending cylinder and a piston which is slidably engaged in said cylinder and which is engageable with said template and displaceable to cause or allow said template to displace relative to said guide element.

17. A pipe bending machine according to claim 16, wherein said guide element further comprises means defining a downwardly directed centering projection disposed to locate said guide element relative to the said axis of pivotation of said bending table.

18. A pipe bending machine according to claim 16, comprising means to feed a fluid pressure medium to said cylinder and means to regulate the pressure of said medium in said cylinder.

19. A pipe bending machine according to claim 16, wherein the centre of said recess is displaced through substantially 45° relative to a bending start end of each of said curved bending surfaces.

20. A pipe bending machine according to claim 16, wherein the spacing of said axis of pivotation of said bending table from a bending start end of one of said curved bending surfaces with a larger one of said radii is substantially equal to the length of the radius of the other one of said curved bending surfaces.

21. A pipe bending machine according to claim 16, wherein said recess is substantially rectangular and is arranged with one of its sides closer to one of said curved bending surfaces having a larger one of said radii then the remaining sides of said recess, and said piston bears at an end thereof facing outwardly of said cylinder against said one of the sides of said recess.

22. A pipe bending machine according to claim 16, wherein said template is provided with means defining guide channels adjoining said recess and said guide element is provided at each of two opposite sides thereof extending in the direction of displacement of said template with means defining a respective rib engaging in a respective one of said channels.

23. A pipe bending machine according to claim 16, wherein said guide element is provided at each of two opposite sides thereof extending in the direction of displacement of said template with means defining lubricating grooves for reception of lubricant.

24. A pipe bending machine according to claim 16, comprising an intermediate plate secured to said bending table, said guide element being mounted on said intermediate plate.

25. A pipe bending machine comprising means defining a feed path;

pipe holding and feeding means operative to hold a pipe to be bent and movable to feed said pipe along said feed path;

a slidable guide member extending in the longitudinal direction of said feed path for guidance of said pipe;

a feed table mounted for pivotation about an axis;

a bending template shiftably mounted on said table to be movable therewith and comprising means defining two curved bending surfaces disposed one at each of two substantially opposite sides of said template and in a single plane for selective bending there-around of said pipe on pivotation of said table with said template, said two curved bending surfaces being of respectively different radii;

clamping means movable with said template and co-operable with said template for clamping of said pipe selectively to said curved bending surfaces in dependence on the radius of a bend to be formed in said pipe;

displacing means operatively connected with said template and operable to displace said template during the bending of the pipe in a horizontal plane and relative to said longitudinal direction of said feed path to compensate for any eccentricity of the centre of curvature of either or each of said curved bending surfaces with respect to said axis of pivotation of said bending table;

said clamping means including a clamping member associated with one of said curved bending surfaces having a larger one of said radii, said clamping member being arranged on said template to be movable in a substantially vertical direction; said template including means defining a clamping surface which is quadrant-shaped in cross-section and which is co-operable with said substantially vertically movable clamping member to effect clamping of said pipe around substantially three-quarters of the circumference thereof;

said clamping means further including a double-acting piston-cylinder unit, the piston of said unit being fixed to said template and the cylinder of said unit being connected to said substantially vertically movable clamping member; and wherein said piston-cylinder unit comprises a piston rod connected to and extending upwardly from said template; an annular piston member mounted on the upper and of said piston rod; a cylinder casing defining a cylinder space which receives said piston member and said piston rod, said piston member slidably engaging the circumferential wall of said cylinder space and said casing being provided at a lower end region thereof with an annular closure member slidably engaging said piston rod; sealing means arranged to effect a seal between said piston member and said circumferential wall of said cylinder space and between said piston rod and said closure member; first duct means for supplying a pressure fluid to a first portion of said cylinder space between said piston member and said closure member thereby to effect lowering of said casing; and second duct means for supplying a pressure fluid to a second portion of said cylinder space between said piston member and the upper end of said casing thereby to effect raising of said casing, said substantially vertically movable clamping member being secured to said casing at said lower end region thereof.

26. A pipe bending machine according to claim 25, wherein said template comprises means defining a socket and said piston rod is mounted in said socket, said template further comprising threaded fastening means inserted from the underside of said template to retain said piston rod in said socket.

* * * * *